US008627758B2

(12) United States Patent
Chang

(10) Patent No.: US 8,627,758 B2
(45) Date of Patent: Jan. 14, 2014

(54) AXIAL PISTON PUMP WITH PISTONS HAVING METALLIC SEALING RINGS

(75) Inventor: Kyong Tae Chang, Academy Town (KR)

(73) Assignee: Neo Mechanics Limited, Hong Kong (HK)

( * ) Notice: Subject to any disclaimer, the term of this patent is extended or adjusted under 35 U.S.C. 154(b) by 0 days.

(21) Appl. No.: 13/405,234

(22) Filed: Feb. 25, 2012

(65) Prior Publication Data

US 2012/0144996 A1 Jun. 14, 2012

Related U.S. Application Data

(60) Provisional application No. 61/446,501, filed on Feb. 25, 2011.

(51) Int. Cl.
*F04B 1/16* (2006.01)

(52) U.S. Cl.
USPC ..... 92/71; 277/458

(58) Field of Classification Search
USPC ..... 92/71; 277/458
See application file for complete search history.

(56) References Cited

U.S. PATENT DOCUMENTS 4,333,661 A * 6/1982 Merrell ..... 277/458
6,813,990 B2 * 11/2004 Shiina ..... 92/71

FOREIGN PATENT DOCUMENTS

| | | | |
|---|---|---|---|
| CN | 2119511 | U | 10/1992 |
| JP | 58013257 | A | 1/1983 |
| JP | 63168363 | U | 11/1988 |
| JP | 2000136771 | A | 5/2000 |

* cited by examiner

*Primary Examiner* — Thomas E Lazo
(74) *Attorney, Agent, or Firm* — Ella Cheong Hong Kong; Margaret A. Burke; Sam T. Yip

(57) ABSTRACT

An axial piston pump, comprising a cylinder block having one or more cylinder bores; and one or more piston assemblies; wherein number of piston assemblies matches number of cylinder bores; wherein each of the piston assemblies having a piston being disposed reciprocating in each of the cylinder bores; and wherein each piston being fitted with a metallic sealing ring, which is a coiled felt seal (CFS), for reducing leakage and keeping concentric of the piston within its corresponding cylinder bore.

11 Claims, 10 Drawing Sheets

AXIAL PISTON PUMP WITH PISTONS HAVING METALLIC SEALING RINGS

CLAIM FOR DOMESTIC PRIORITY

This application claims priority under 35 U.S.C. §119 to the U.S. Provisional Patent Application No. 61/446,501, filed Feb. 25, 2011, the disclosure of which is incorporated herein by reference in its entirety.

CROSS REFERENCES TO RELATED APPLICATIONS

This application is related to the Korea Patent Application No. 10-2006-0031762, filed Apr. 7, 2006, the disclosure of which is incorporated herein by reference in its entirety.

COPYRIGHT NOTICE

A portion of the disclosure of this patent document contains material, which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF THE INVENTION

The presently claimed invention relates generally to axial piston pump and more specifically relates to the mechanics of the cylinder and piston.

BACKGROUND

Axial piston pumps are well known in the art. A typical axial piston pump comprises of a cylinder block on which a number of cylinder bores are made and a piston assembly is disposed in a sliding manner in each of the cylinder bores. The piston assemblies connect to a swashplate, which translates a rotating motion to the reciprocating motion of the pistons. During operation, the pistons reciprocate in the cylinder bores of the cylinder block either by rotating cylinder block itself while the swashplate standing still or by rotating the swashplate while the cylinder block is standing still. In either model, rotating cylinder block or rotating swashplate, the clearance between the cylinder wall and a reciprocating piston is critical to the performance of the axial piston pump because the leakage between the cylinder wall and reciprocating piston, which is called internal leakage, is one of the greatest factors contributing to fatal power loss of the axial piston pump.

The typical axial piston pumps are designed and manufactured for the operating temperature range of −30° C. to +150° C. The alloy for the cylinder block is usually copper based brass family for the bearing functionality and the alloy for piston is usually chromium based hard steel for the higher durability. Using two different alloys leads to the two parts having different thermal expansion rates along the atmospheric and internal temperature changes. It in turn causes the expansion and contraction of the clearances between the cylinder walls and the pistons. Stuck cylinders under high temperature and severe leakages under low temperature are major problems. Therefore, the optimum clearance is one that is large enough to avoid the stuck cylinder condition under high temperature, but small enough to prevent sever leakages under low temperature. Traditionally, the achievement of optimum clearance relies solely on machining and finishing accuracy of the piston and cylinder bore during manufacturing. However, the wear and tear of the cylinder and piston over time, thus deviation from the optimum parameter, is unavoidable.

The competing criteria imposed by the clearance size and thermal expansion and contraction characteristics also pose difficult manufacturing challenges including a narrow selection of cylinder block and piston materials and applicable heat treatment processes.

The presently claimed invention is directed to overcoming the aforementioned problems by providing an axial piston pump with pistons having metallic sealing rings.

SUMMARY

It is an objective of the presently claimed invention to provide a design of axial piston pump with pistons having metallic sealing rings such that deficiencies of stuck cylinder and severe leakage caused by sub-optimal clearance between cylinder walls and pistons can be eliminated. It is a further objective of the presently claimed invention to provide such design of axial piston pump with pistons having metallic sealing rings by using coiled felt seal (CFS), that is a helical coiled metal seal applied on the pistons.

In accordance to various embodiments of the presently claimed invention, pistons are fitted with CFS having flexibility within the range of 0.1% of the cylinder bore. The result is that during the manufacturing of the axial piston pump, the grinding and lapping process of the cylinder bore and piston surface would not be necessary. The range of choice of alloy for the piston and cylinder block is widen. Ultimately, the use of CFS reduces the material and machining cost while increases the performance of the axial piston pump reduced leakage.

BRIEF DESCRIPTION OF THE DRAWINGS

Embodiments of the invention are described in more detail hereinafter with reference to the drawings, in which.

DETAILED DESCRIPTION

In the following description, designs of axial piston pump with pistons having metallic sealing rings are set forth as preferred examples. It will be apparent to those skilled in the art that modifications, including additions and/or substitutions may be made without departing from the scope and spirit of the invention. Specific details may be omitted so as not to obscure the invention; however, the disclosure is written to enable one skilled in the art to practice the teachings herein without undue experimentation.

Figure 1:
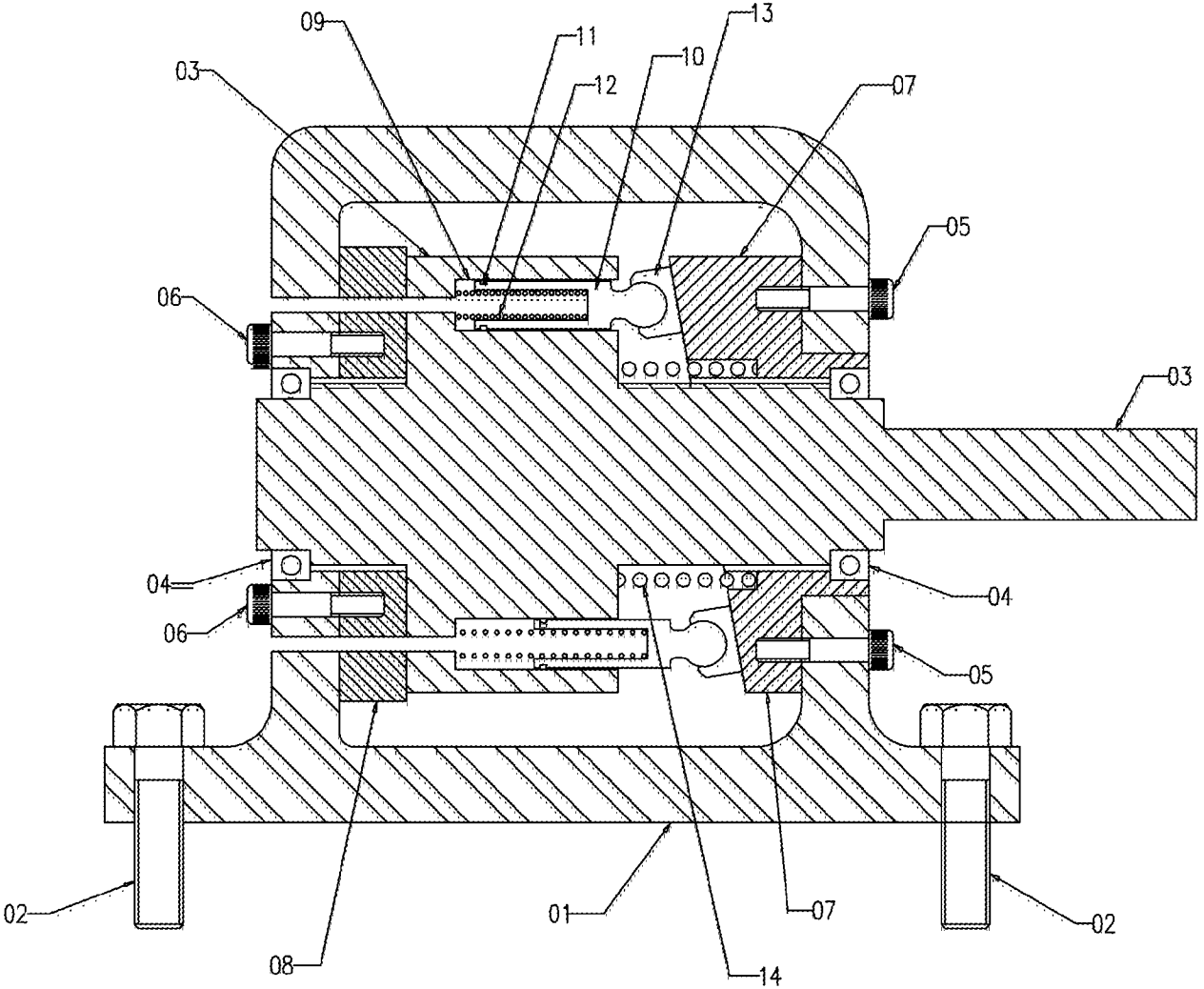
FIG. 1 shows the cross-sectional view of one embedment of a cylinder block rotating type axial piston pump.

Referring to FIG. 1. The cross-sectional view of one embedment of a cylinder block rotating type axial piston pump is shown. The axial piston pump comprises at least a pump housing 01 enclosing all the pump components. The pump housing 01 can be mounted on the main machine using bolts 02. A valve plate 08 and a swash plate 07 are assembled inside of the housing body 01 and are secured in place using bolts 05 and bolts 06. The cylinder block 03, in which the cylinder bores 09 are made, is mounted inside the pump housing 01 on bearings 04. The cylinder block 03 is being pressed toward valve plate 08 by push spring 14, keeping the valve plate 08 and cylinder block 03 firmly contacted. The piston seals 11, which are coiled felt seals (CFSs), are installed on the pistons 10. The piston seals 11 ensures zero or close-to-zero leakage between the cylinder bores 09 and the pistons 10. As a result, energy saving and higher pump performance are achieved.

Figure 2:
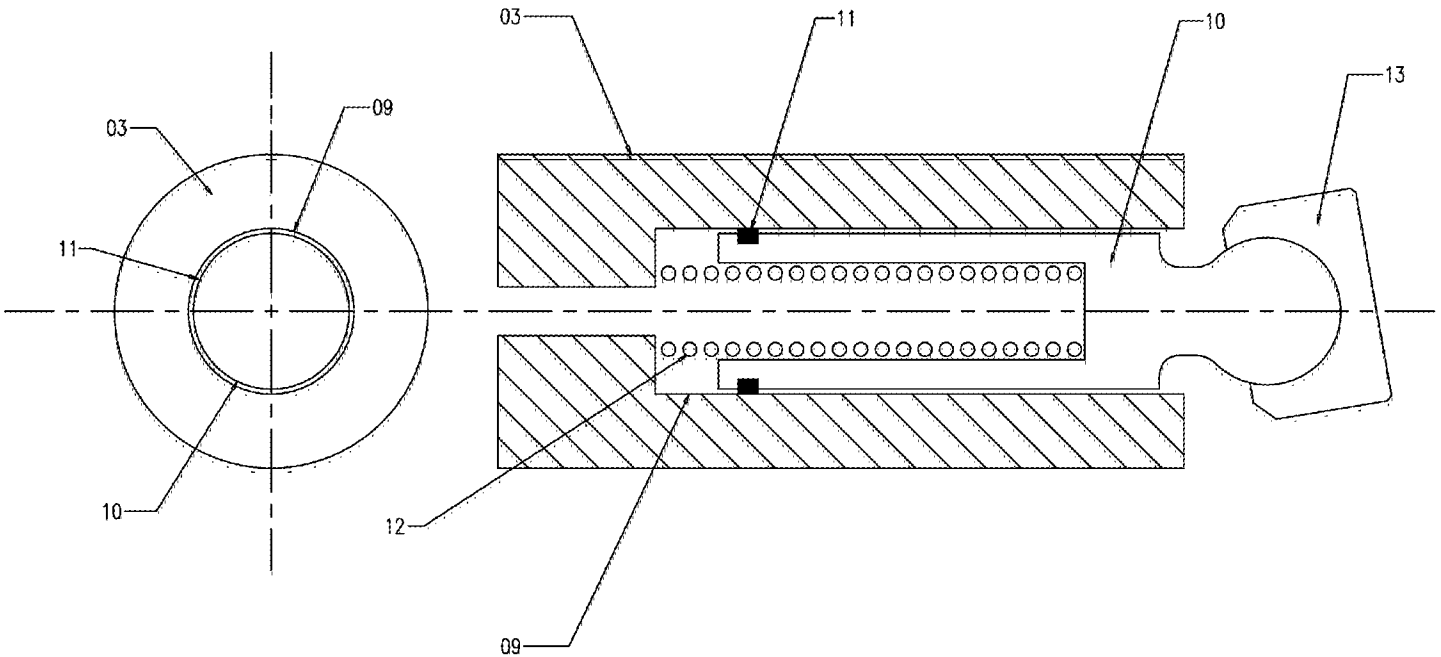
FIG. 2 shows the cross-sectional and front views of an exemplary cylinder block with a disposed CFS fitted piston.
Figure 3:
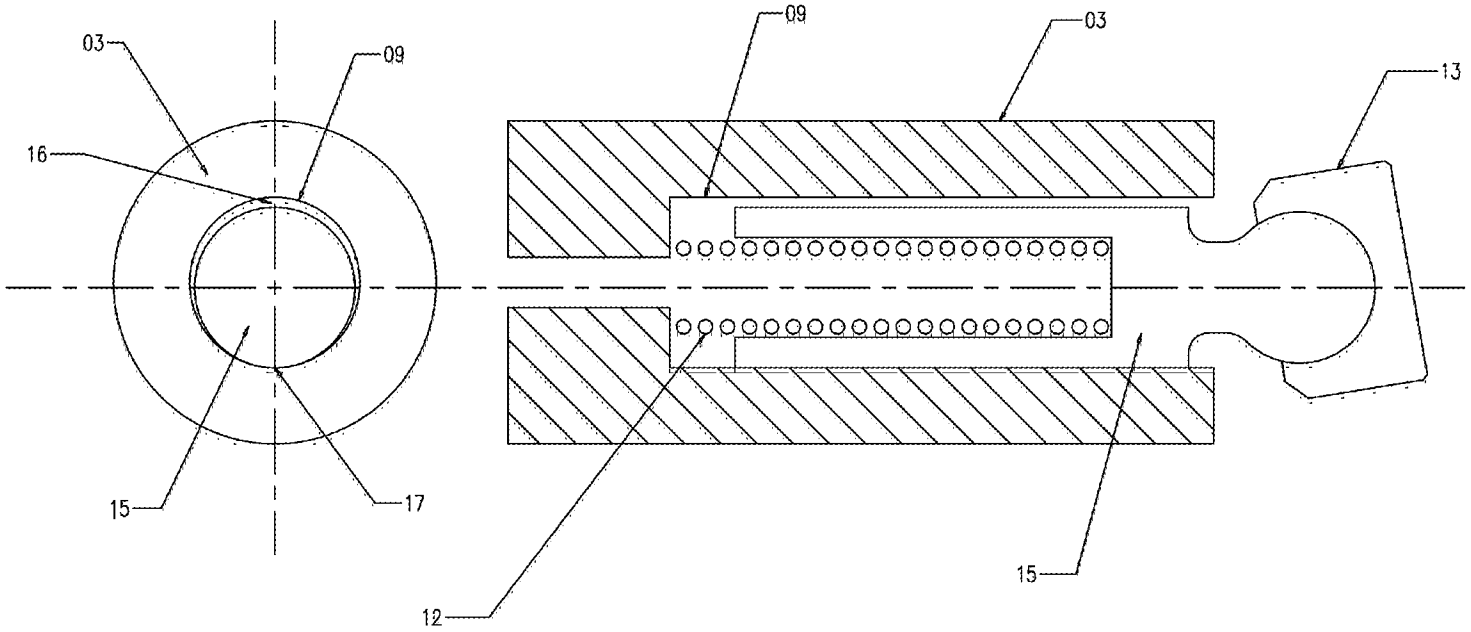
FIG. 3 shows the cross-sectional and front views of an exemplary cylinder block with a disposed piston without any sealing means.
Figure 4:
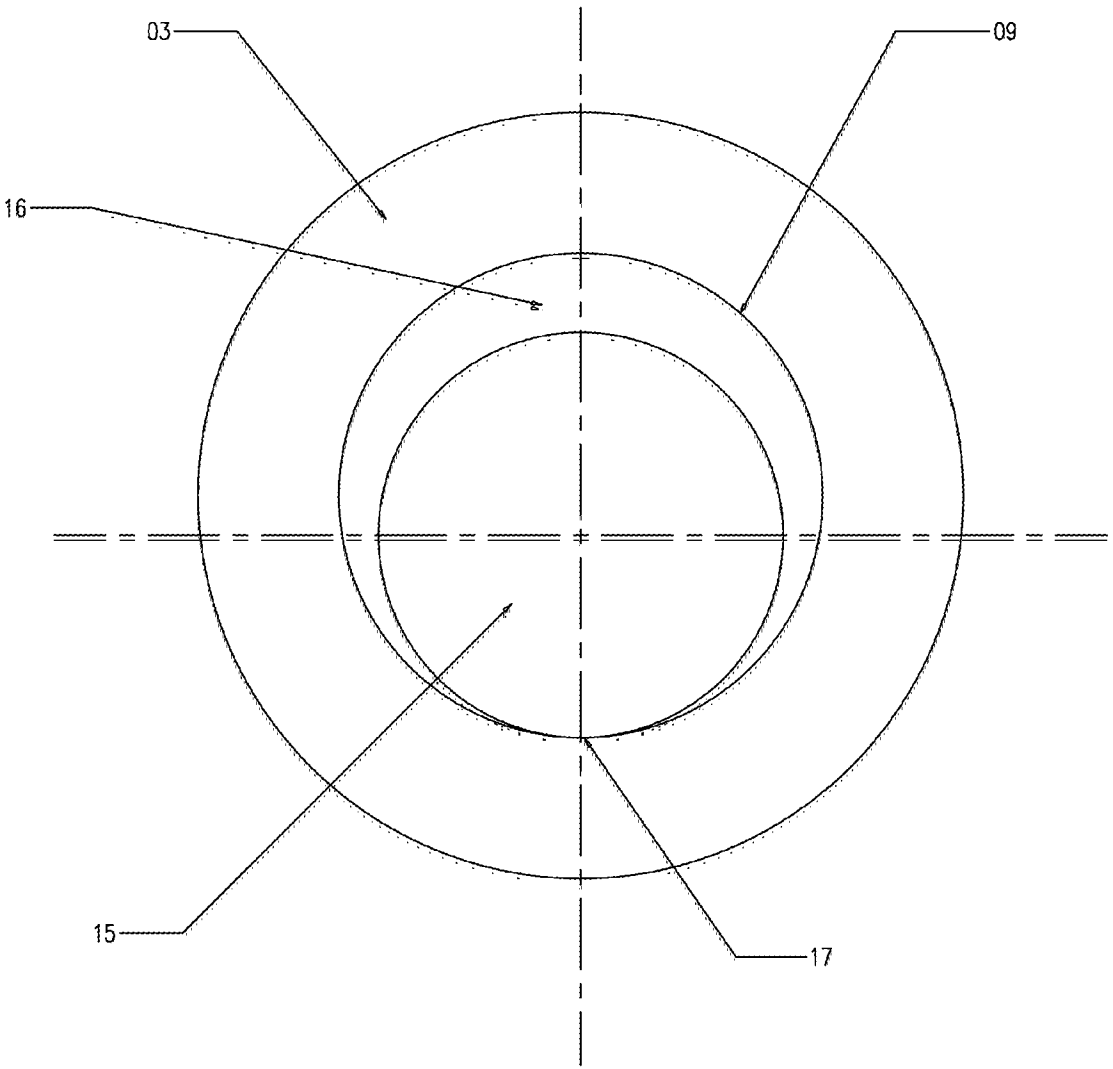
FIG. 4 shows the front view of an exemplary cylinder block with a disposed piston without any sealing means that with emphasis on the eccentricity of between the cylinder bore and piston.

Referring to FIG. 2 and FIG. 3. The CFS piston seal 11 is shown more clearly in the cross-sectional view in FIG. 2. As can be seen in the front view in FIG. 2, the CFS piston seal 11 also keeps perfect concentric of the piston 10 within the cylinder bore 09. This ensures longer life of the two contacting parts by maintaining evenly distributed contact of two rubbing surfaces. In contrast, a piston without a piston seal, as shown as 15 in FIG. 3, can roam around sideways in the cylinder bore 09. Consequently severe leakage from the excessive space 16 can result.

Referring to FIG. 1. The pistons 10 are exerted outward from cylinder block 03 by the piston springs 12. The exertion ensures that the exposed ends of the pistons 10 having firm contacts with the swashplate 07 through the ball joints 13. As the cylinder block 03 rotates, the exposed ends of the pistons are constrained to follow the surface of the swashplate 07. Since the swashplate 07 is at an angle to the axis of rotation, the pistons must reciprocate axially, driving the pumping action.

One embodiment of the CFS, called the helical spring tube type dynamic rotary seal, and its exemplary application are described in the Korea Patent Application No. 10-2006-0031762. Excerpts of its English translation are presented in the Appendix A of the present document.

The foregoing description of the present invention has been provided for the purposes of illustration and description. It is not intended to be exhaustive or to limit the invention to the precise forms disclosed. Many modifications and variations will be apparent to the practitioner skilled in the art.

The embodiments were chosen and described in order to best explain the principles of the invention and its practical application, thereby enabling others skilled in the art to understand the invention for various embodiments and with various modifications that are suited to the particular use contemplated. It is intended that the scope of the invention be defined by the following claims and their equivalence.

Appendix A

Helical Spring Tube Type Dynamic Rotary Seal Constructed With C-type Partial Rings, Which are Joined by Dovetail Joint Method

BRIEF DESCRIPTION OF DRAWINGS

Figure 5:
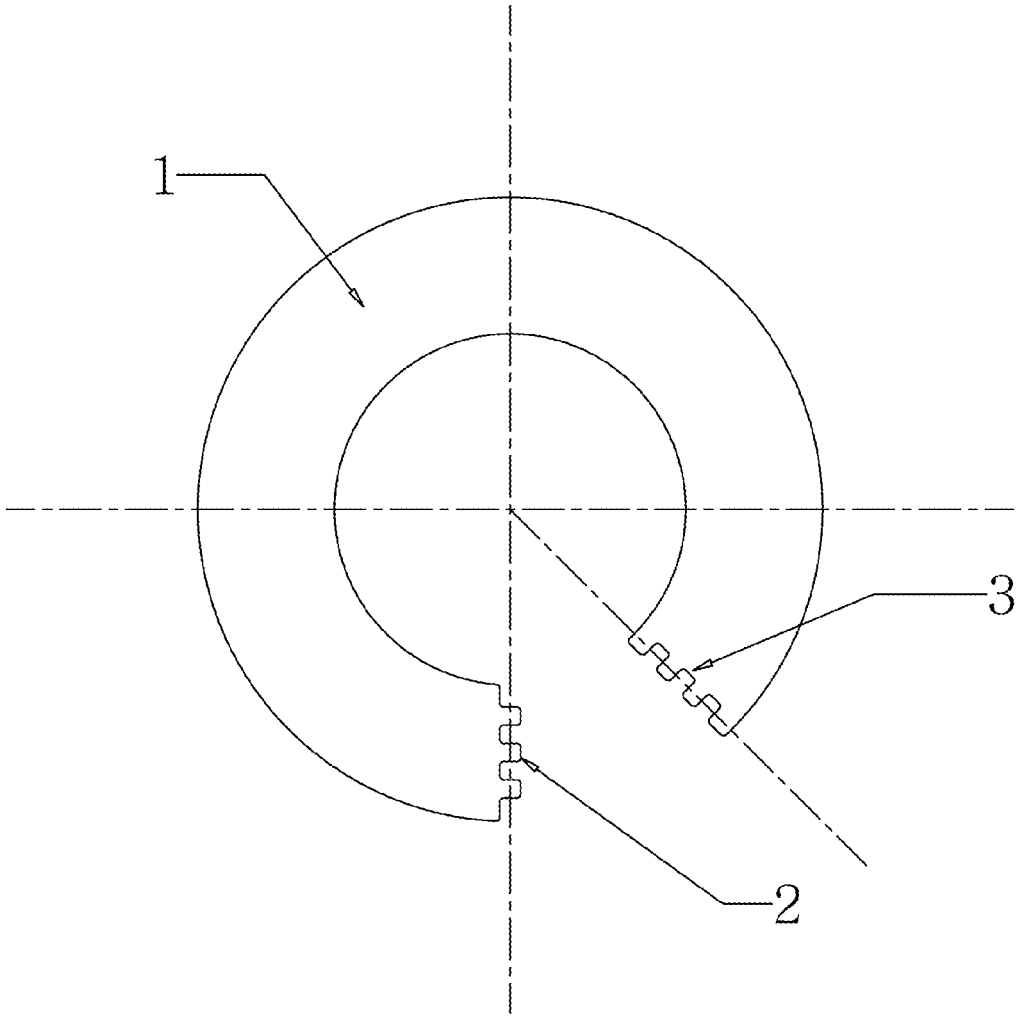
FIG. 5 shows a partial ring, which could be press stamped out of thin metal sheet, that having male and female dovetail joint shape on two ends to make the joints be strong when progressively joined.

FIG. 5: Partial ring which could be press stamped out of thin metal sheet, that having male and female dovetail joint shape on two ends to make the joints be strong when progressively joined.

Figure 6:
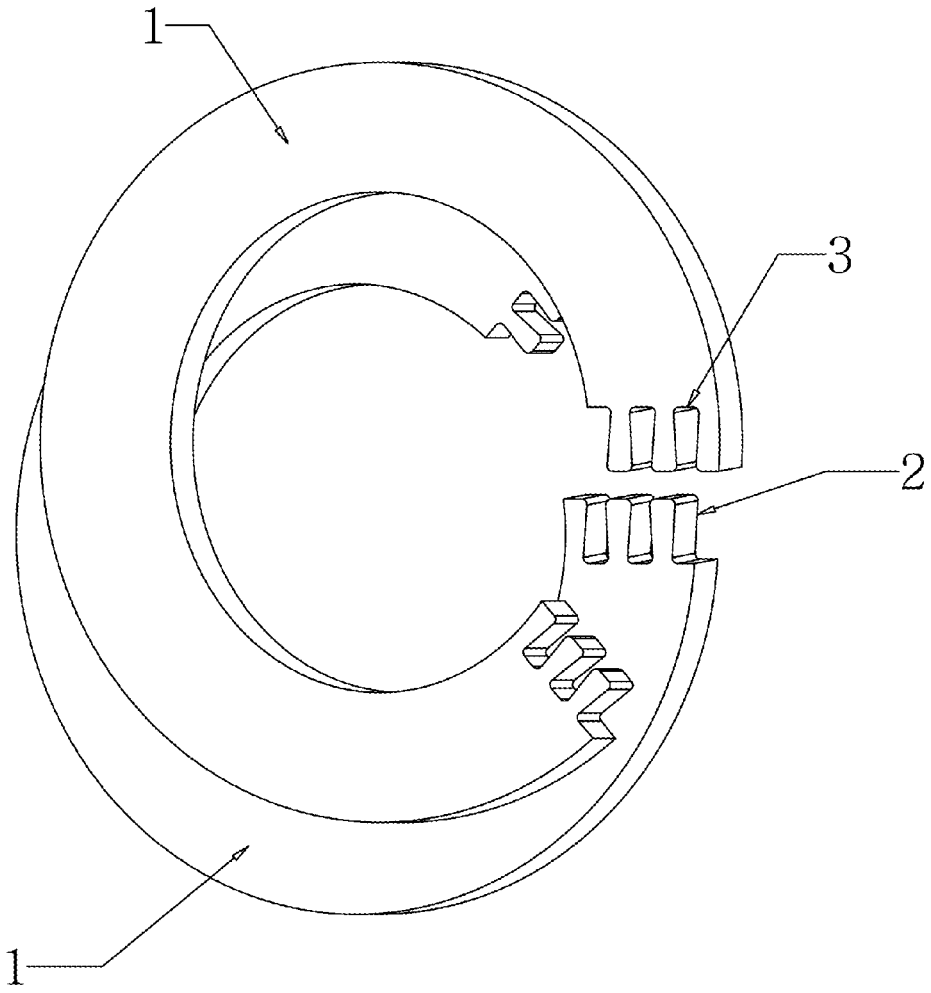
FIG. 6 shows two partial rings are overlapped to insert male dovetail of first partial ring into female dovetail of next partial ring for progressive joining to construct helical wound tube.

FIG. 6: Two partial rings are overlapped to insert male dovetail of first partial ring into female dovetail of next partial ring for progressive joining to construct helical wound tube.

Figure 7:
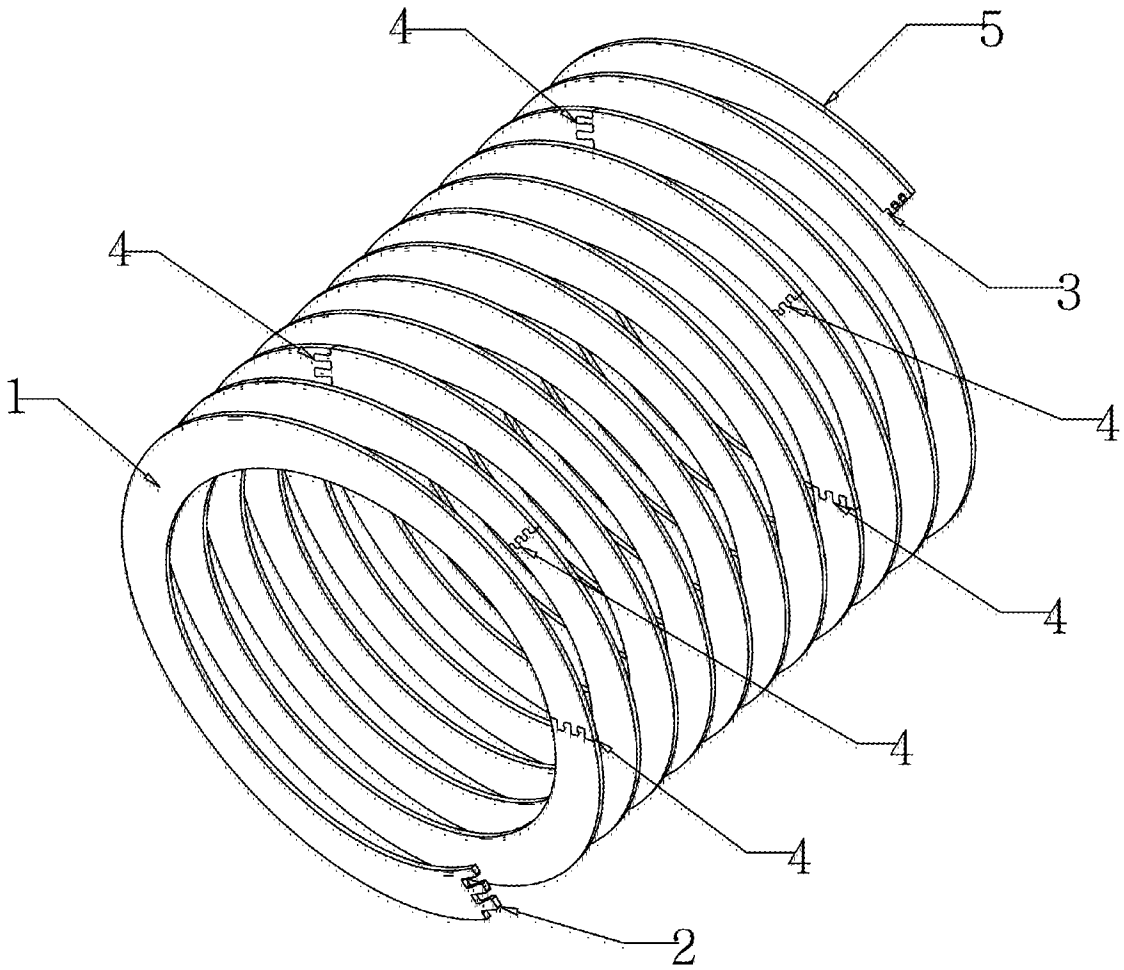
FIG. 7 shows a blank of the tubular shape seal, which is a metal strap wound helical tube.

FIG. 7: Blank of the tubular shape seal of this invention, which is metal strap wound helical tube.

Figure 8:
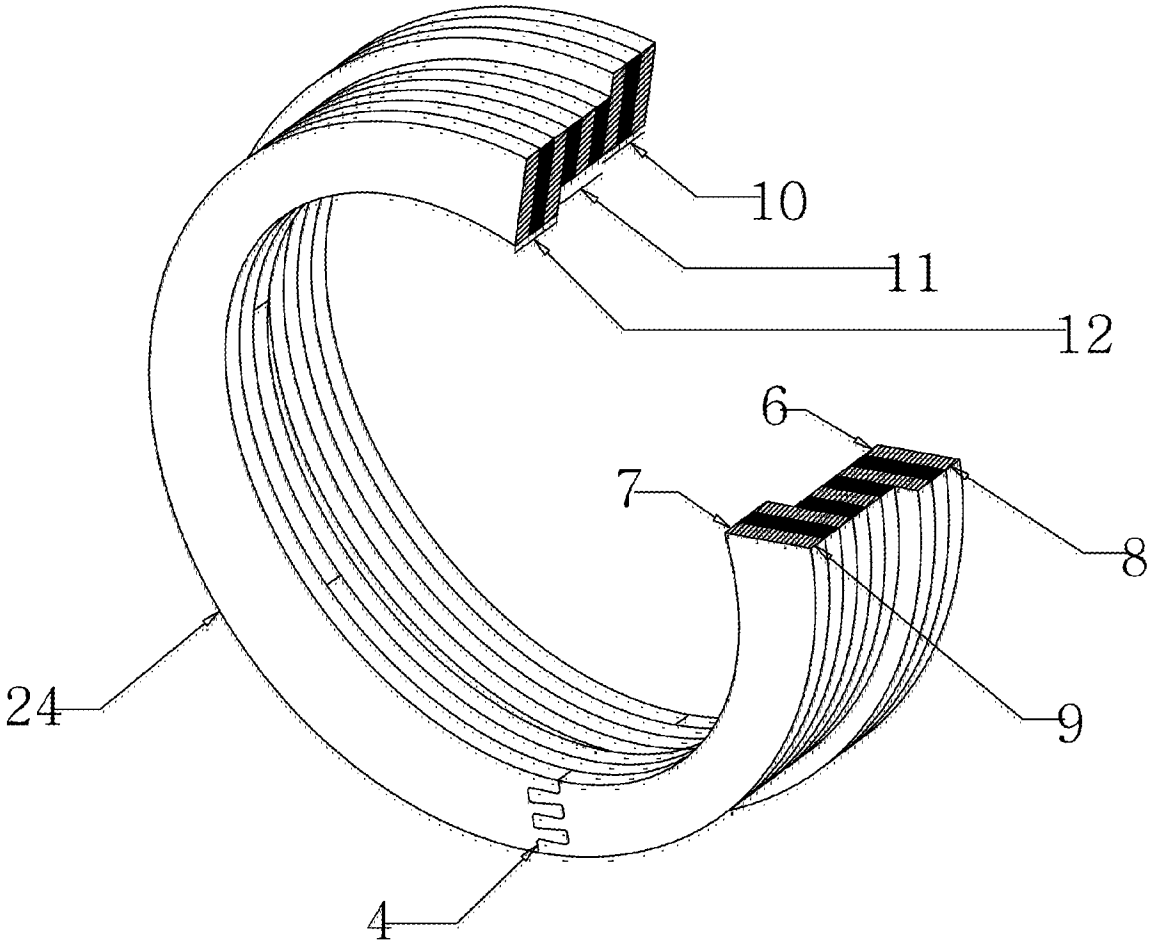
FIG. 8 shows a partially cutaway view of completed dynamic seal which is completed by grinding the inside and outside diameter of the blank to have proper function in the seal.

FIG. 8: Partially cutaway view of completed dynamic seal of this invention which is completed by grinding the inside and outside diameter of the blank to have proper function in the seal.

Figure 9:
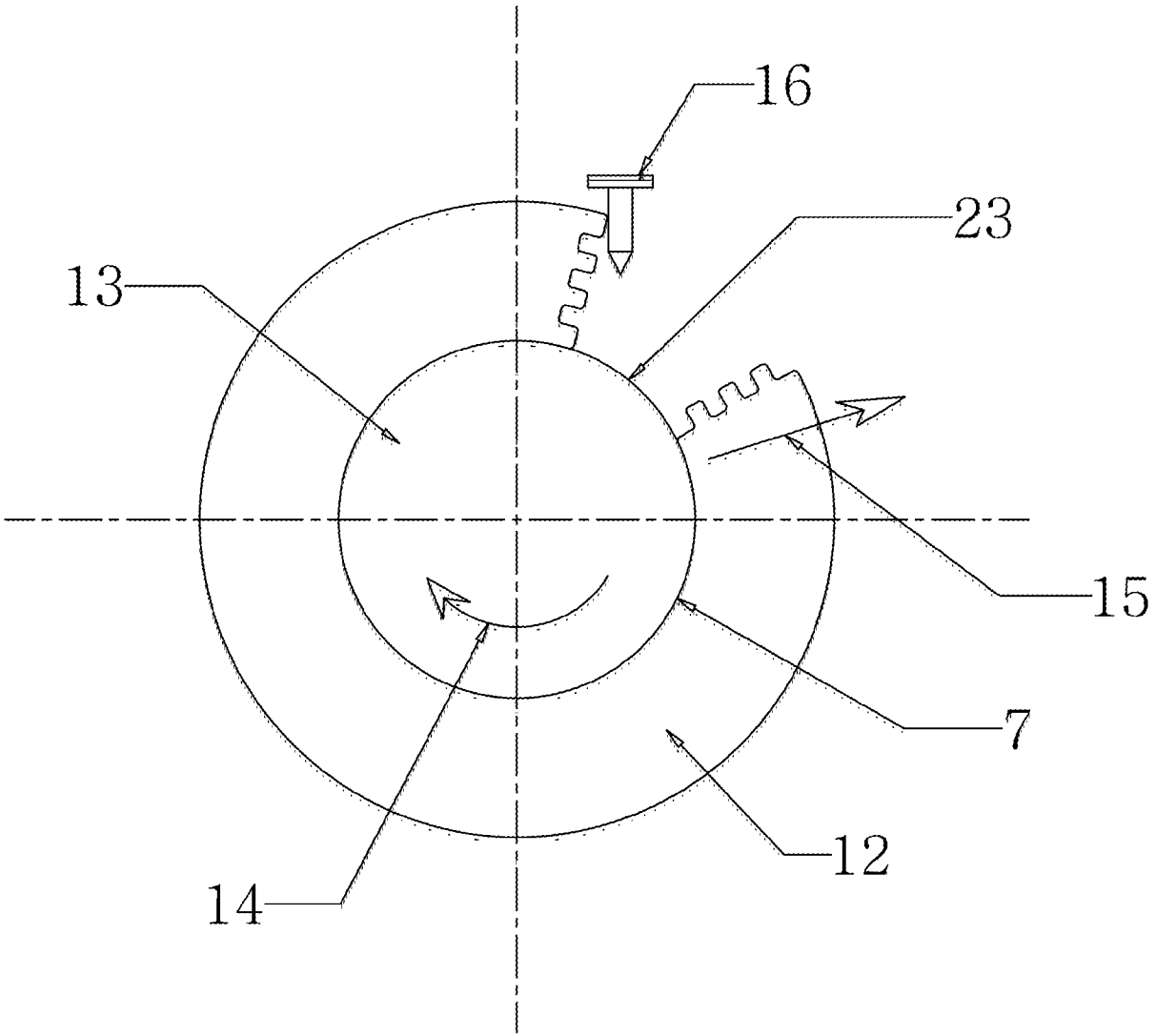
FIG. 9 shows a partial ring with assisting imaginary parts to explain the dynamic rotary seal principle.

FIG. 9: A partial ring with assisting imaginary parts to explain the dynamic rotary seal principle with this invention.

Figure 10:
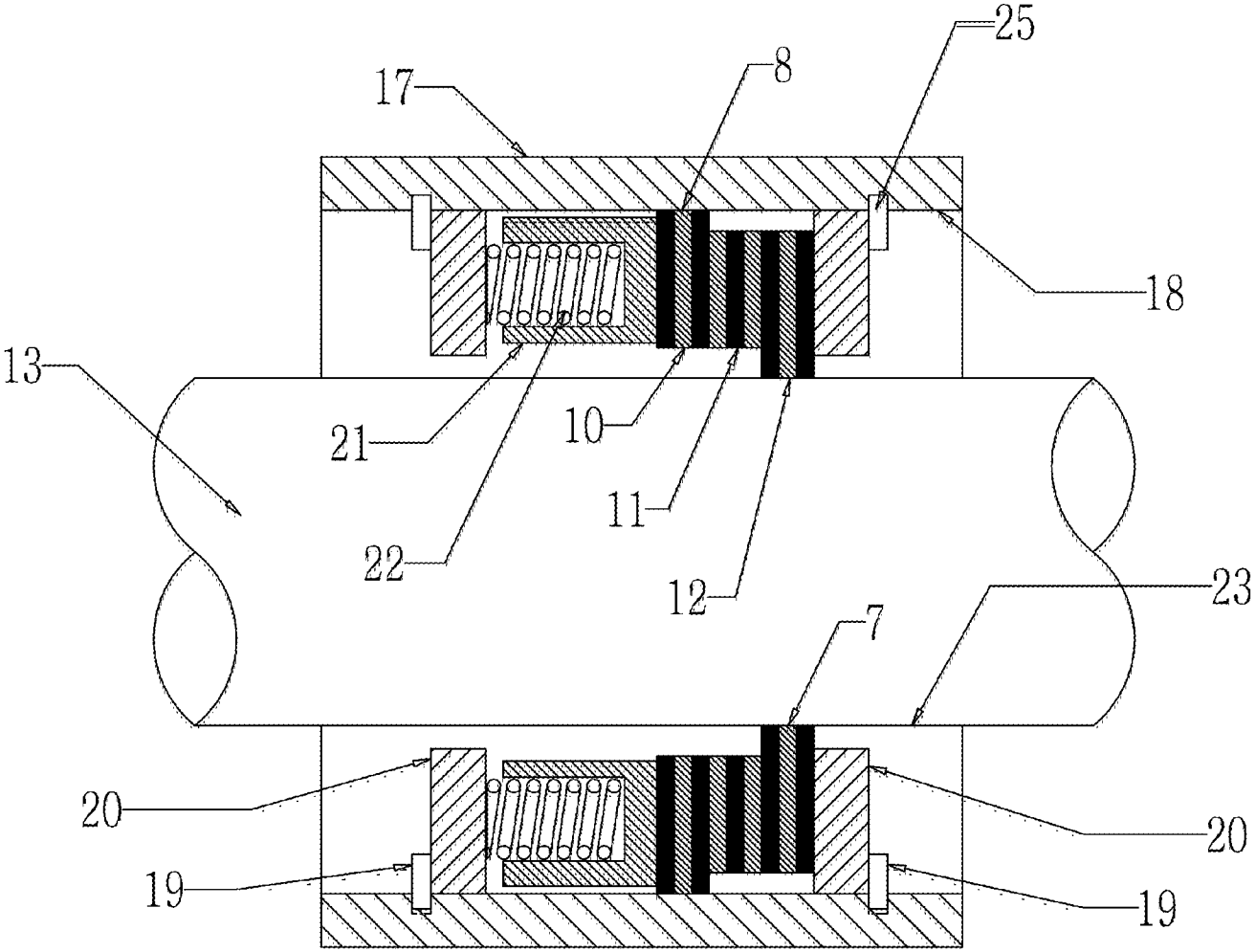
FIG. 10 shows a half cutaway view of an example of completed dynamic rotary seal.

FIG. 10: Half cutaway view of example of completed dynamic rotary seal using this invention.

Explanation Of Numbered Parts In The Drawings FIG. 5-10

1—A partial ring stamped out of thin metal sheet.
2—Male end of dovetail joint on C-type partial ring.
3—Female end of dovetail joint on C-type partial ring.
4—Dovetail Joint line, which is the result of dovetail joining of C-type partial rings.
5—Helical spring tube constructed by progressive joining of number of C-type partial rings along the helical track.
6—Shaft free circle that made slightly bigger diameter than the shaft diameter to keep it away from shaft all the time.
7—Shaft contact circle that made slightly smaller than shaft diameter to make it keep contact with shaft all the time.
8—Housing contact circle that made slightly bigger than inside diameter of the housing to make it keep contact with housing all the time.
9—Housing free circle that made slightly smaller than inside diameter of the housing to keep it away from the housing all the time.
10—Hosing seal layer whose outside diameter is housing contact circle and inside diameter is shaft free circle.
11—Displacement absorption layer whose outside diameter is housing free circle and inside diameter is shaft free circle.
12—Shaft seal layer whose outside diameter is housing free circle and inside diameter is shaft contact circle.
13—Shaft.
14—Arrow to indicate the shaft rotating direction.
15—Arrow to indicate the spreading direction of shaft seal ring when the ring spreads.
16—An imaginary pin which blocks rotating of shaft seal ring.
17—Housing.
18—Inside diameter of the housing.
19—Snap ring that inserted in snap ring groove to the hold holding ring.
20—Holding ring that holds the seal ring assembly.
21—Compression ring that pushes source rings of seal ring assembly to keep all the rings in seal ring assembly be tightly contacted one another to block leak between rings.
22—Compression spring to provide compression force of compression ring.

23—Outside diameter of the rotating shaft.
24—Completed seal assembly.
25—Snap ring groove.

DETAILED DESCRIPTION

Category of this invention falls in the dynamic blocking technology of the leak that inevitably arising between stationary housing and rotating shaft when pressure rises in the rotary compression system.

The dynamic rotary seal used on screw type compression system is called "mechanical seal". A mechanical seal is composed of six parts in minimum, which are the stator block, rotor block, stator disk, rotor disk, rotor disk spring and rotor block disk seal. The entire seal function fails if any one of these parts fails. The stator disk and the rotor disk are the parts that perform the actual sealing function by contacting rubbing rotating under pressure. Those two parts must have not only high wear resistance but also low friction. They must be able to dissipate heat in possible highest speed.

Surface area can be adjusted for less contacting area for less friction heat but the less area results faster wear out. High wear resistant materials have high friction but low friction material having low wear resistance. If they are made with high wear resistant material for long life the friction heat could affect the quality of the media in contact, in some cases even bring fire.

Two contacting faces in mechanical seal are under pressure and constantly rubbing so they are wearing in all instance even submicron unit range but that submicron wear clearance always causes whole seal failure when the submicron wear is not compensated in every instance along with wear out.

In other words, one of the contacting disk, rotating disk, must move toward the mating disk, the stationary disk, to compensate wear. This means the rotating disk must travel axial direction toward the stationary disk on the rotating block while the rotating block is rotating. Rotating disk must be able to slide on the rotating block to constantly move toward the stationary disk. Thus there is another place to block leak between rotating disk and rotating block.

The axial direction movement of the rotating disk on the rotating block by wear out of disk is very little distance, within few mm in a year, so the sealing between rotating disk and rotating block could be satisfied by simple rubber O-ring for cheaper model and by metal bellows for higher performance. In short the real problem in rotary dynamic seal in prior art is in the sealing between rotating disk and rotor block, not only in contacting disks.

A rubber O-ring inserted between rotating disk and rotor block shall be burnt in high temperature media and shall be extruded under high pressure media and be attacked in the corrosive media but there are no ways to omit it.

Metal bellows are more expensive, sometimes three times of the whole mechanical seal, and the metal bellows makes complicate structure which hinders thin compact design that is very important in precision machines.

The ultimate target is to produce single piece rotary dynamic seal which is compact, higher sealing performance, cheaper and lower maintenance while the rotary dynamic sealing system of prior art which generally called mechanical seal having so many parts are inevitably inter related, complicate structure, expensive in production cost, higher maintenance cost and shorter life.

FIG. 5 shows the C-shaped partial ring(1) which is the basic source ring of this invention. Partial ring(1) must be stamped out by press or fabricated by contour cutting process such as laser cutting or wire cutting from sheet stock to have two faces of partial ring(1) in perfect parallel. C-shaped partial ring(1) is a ring that made to have a part of the ring cut away so as to make the partial rings be progressively joined by the male dovetail(2) and female dovetail(3) made on two ends of the partial ring(1). The value of the cut away angle should be determined accordingly along with diameter.

FIG. 6 shows the method of progressive joining of two partial rings(1) by the male dovetail(2) of first partial ring(1) and female dovetail(3) of next partial ring(1).

FIG. 7 shows the completed helical spring tube(5) by progressive joining of partial rings(1) and those dovetail joint line(4) must be permanently set by welding or brazing after joining The starting point shows the male dovetail(2) and the ending point shows female dovetail(3) on completed helical spring tube(5). As the helical spring tube(5) is constructed by the progressive joining of the partial rings(1) the dovetail joint line(4) shall be distributed on the tube surface on shifted point as much as the cutaway angle of the partial ring(1) so the dovetail joint line(4) will be adequately distributed on tube surface evading weak joint points be overlapped.

FIG. 8 shows the partial cutaway view of seal assembly(24) which is completed sealing ring of this invention. The seal assembly(24) is completed by grinding of inner diameter and outer diameter by making 4 different diameters, two on inside and two on outside of the helical spring tube(5). The smaller diameter of the inside diameter of seal assembly (24) is called shaft contacting circle(7) which is made about 0.5% smaller than the outside diameter of the shaft(23) so as to tightly contact with shaft(13) all the time when the shaft(13) is inserted inside of the seal assembly(24). The larger diameter of the inside diameter of seal assembly(24) is called shaft free circle(6) which made little larger than the outside diameter of the shaft(23) so as to prevent shaft free circle(6) from contacting outside diameter of the shaft(23) at anytime. The larger diameter of the outside diameter of seal assembly(24) is called housing contact circle(8) which is made about 0.5% larger than the inside diameter of the housing(18) so as to keep the housing contact circle(8) tightly contact all the time with inside diameter of the housing(18) when the seal assembly(24) is assembled inside of the housing(17). The smaller diameter of the outside diameter of the seal assembly (24) is called housing free circle(9) which made little smaller than the inside diameter of the housing(18) to prevent the housing free circle(9) from contacting the inside diameter of the housing(18) at anytime. The purpose of making these 4 different diameter circle is to build three different functioned layers in the seal assembly(24). The first layer is called housing seal layer(10), which is the stacking of the housing seal rings whose outside diameter is housing contact circle(8) and inside diameter is shaft free circle(6). The function of the housing seal layer is blocking the leak between inside diameter of the housing(18) and seal assembly(24) and the number of the rings to construct layer for optimum sealing performance shall be determined by designer according to different sizes. The second layer is called shaft seal layer(12) which is the stacking of the shaft seal rings whose outside diameter is housing free circle(9) and inside diameter is shaft contact circle(7). The function of the shaft seal layer is blocking the leak between outside diameter of the shaft(23) and seal assembly(24) and the number of the rings to construct layer for optimum sealing performance shall be determined by designer according to different sizes. The third layer is called displacement absorption layer(11) which is stacking of the suspended rings whose outside diameter is housing free circle (9) and the inside diameter is shaft free circle(6). The displacement absorption layer(11) is built between the housing seal layer(10) and the shaft seal layer(12) to absorb eccentric vibration of the shaft and also absorbs the dimensional change of the whole system by wearing along with use.

FIG. 9 shows the principle of the sealing of this invention. Since those three different functioned layers are constructed on a single strand of metal strap any force put to any point of the seal assembly(24) is immediately affects to all over the seal assembly(24). When the seal assembly(24) is inserted inside of the housing(17) with force the seal assembly(24) is tightly caught inside of the housing(17) because the outmost diameter of the seal assembly(24) is the housing contact circle(8) which is 0.5% larger than the inside diameter of the housing(18). As the housing seal layer(10) is tightly caught to the housing(17) whole seal assembly(24) is caught in the housing(17) so is the shaft seal layer(12). The innermost diameter of the seal assembly(24) which is the inner diameter of the shaft seal layer(12) is shaft contact circle(7) which is made about 0.5% smaller than the outside diameter of the shaft(23) so if the shaft(13) is inserted into shaft seal layer(12) by force whole shaft seal layer(13) must be tightly stick to shaft(13). If the shaft(13) starts rotate the shaft seal layer(12) also starts to rotate together with shaft(13) but the housing seal layer(10) which is tightly caught inside of the housing (17) prevents the shaft seal layer(12) from rotating.

This condition is as same as the FIG. 9 that shows one partial ring of the shaft seal layer(12) is about to start rotate by the rotating force of the shaft(13), the stopping action of the housing seal layer(10) is shown by imaginary stop pin(16). The shaft contact circle(7) is holding shaft diameter(23) but the shaft(13) starts to rotate to arrow(14) direction while the stop pin(16) prevents the ring(12) from rotate, then the friction force between shaft contact circle(7) and shaft diameter (23) is converted to open the partial ring(12) to the arrow(15) direction. When the partial ring(12) opens by the force arrow (15) direction the contacts between the ring(12) and shaft(13) is broken, other words there remain no more contact in that instance. No more contact means no more friction force generates so opening of the ring(12) is ended and spring back to its original position. Back to its original position of the ring (12) means the contacting of the ring(12) and shaft(13) and next instance the friction force opens the ring(12) again. The opening between the ring(12) and the shaft(13) could be a millionths of a mm since the open is open no matter how small value was the opening which is enough distance to eliminate contacting. So the open and close of the ring(12) could arise million times in a second in other words the opening clearance also could be millionths of a mm through which nothing can be leak in a millionths of a second. This condition is as same as the static seal of plain rubber O-ring since the contacting of ring(12) and shaft(13) is virtually never broken during the rotating of the shaft(13). This status is a unique phenomenon arising between helical spring and rotating round bar inserted inside of the spring, the condition should be called contacting non contacting condition. This contacting non-contacting phenomenon is utilized on helical spring over running clutch from long time ago but utilizing this phenomenon on dynamic seal is the first on this invention.

FIG. 10 is the representative drawing which shows the cutout view of completed dynamic rotary seal using seal assembly(24). There must be some means to hold the seal assembly(24) inside the cylinder(17) including holding ring (20) and snap ring(19) which is inserted in the snap ring groove(25). The compression ring(21) also provided to push source rings together to block leak between source rings by the spring force of the compression springs(22) which inserted in the holes made on the compression ring(21).

What is claimed is:

1. An axial piston pump, comprising:

a cylinder block having one or more cylinder bores; and one or more piston assemblies;

wherein number of piston assemblies matches number of cylinder bores;

wherein each of the piston assemblies having a piston being disposed reciprocating in each of the cylinder bores;

wherein each piston being fitted with a metallic helical coiled sealing ring for reducing leakage and keeping concentric of the piston within its corresponding cylinder bore;

wherein the metallic helical coiled sealing ring comprising partial rings having male and female dovetails on two ends of each partial ring;

wherein the partial rings being progressively joined by the male and female dovetails to form a helical spring; and wherein the helical spring tube being further grinded on the inner diameter and outer diameter of the helical spring tube to make four different diameter circles, with two of the diameter circles on the inside and two of the diameter circles on the outside of the helical spring tube to form a seal assembly.

2. The axial piston pump of claim 1, further comprising a swashplate; the swashplate connecting the piston assemblies, constricting the pistons to follow the swashplate surface, rotating at an angle to the cylinder block axis of rotation, and causing the pistons to reciprocate axially.

3. The axial piston pump of claim 1, wherein the partial ring is C-shaped.

4. The axial piston pump of claim 1, wherein the partial ring has two faces which are substantially in parallel.

5. The axial piston pump of claim 1, wherein the partial ring is stamped out by press or fabricated by contour cutting process.

6. The axial piston pump of claim 5, wherein the contour cutting process is laser cutting or wire cutting from sheet stock.

7. The axial piston pump of claim 1, wherein the partial ring is thin metal sheet or metal strap.

8. The axial piston pump of claim 1, wherein the four different diameter circles forming three different functioned layers in the seal assembly, which are the housing seal layer, the shaft seal layer and the displacement absorption layer.

9. The axial piston pump of claim 8, wherein the housing seal layer comprises the stacking of housing seal rings, the shaft seal layer comprises the stacking of shaft seal rings, and the displacement absorption layer comprises the stacking of suspended rings.

10. The axial piston pump of claim 9, wherein the housing seal layer is for blocking the leak between the interior wall of its corresponding cylinder bore and the seal assembly, the shaft seal layer is for blocking the leak between the outside diameter of the piston and the seal assembly, and the displacement absorption layer is for absorbing any eccentric vibration of the piston and for absorbing any dimensional change of the seal assembly due to wearing along with use.

11. The axial piston pump of claim 10, wherein the outer diameter of the housing seal layer is 0.5% larger than the diameter of the interior wall of its corresponding cylinder bore.

* * * * *